US009377278B2

(12) United States Patent
Rubin

(10) Patent No.: US 9,377,278 B2
(45) Date of Patent: Jun. 28, 2016

(54) BIOLOGICAL ACTIVE BULLETS, SYSTEMS, AND METHODS

(71) Applicant: Darren Rubin, Largo, FL (US)

(72) Inventor: Darren Rubin, Largo, FL (US)

( * ) Notice: Subject to any disclaimer, the term of this patent is extended or adjusted under 35 U.S.C. 154(b) by 0 days.

(21) Appl. No.: 14/615,671

(22) Filed: Feb. 6, 2015

(65) Prior Publication Data

US 2016/0131464 A1 May 12, 2016

Related U.S. Application Data

(63) Continuation-in-part of application No. 13/461,863, filed on May 2, 2012, now Pat. No. 9,200,877.

(51) Int. Cl.
*F42B 12/54* (2006.01)
*F42B 12/72* (2006.01)

(52) U.S. Cl.
CPC ..... *F42B 12/54* (2013.01); *F42B 12/72* (2013.01)

(58) Field of Classification Search
CPC ..... F42B 12/36; F42B 12/38; F42B 42/40; F42B 12/44; F42B 12/46; F42B 12/54
USPC ..... 102/511, 512, 513, 458, 364, 365
See application file for complete search history.

(56) References Cited

U.S. PATENT DOCUMENTS 3,557,698 A * 1/1971 Hart ..... F42B 12/42 102/336
3,645,208 A * 2/1972 Weinssen ..... F42B 12/40 102/513
4,419,936 A * 12/1983 Coates ..... C06C 9/00 102/364
4,495,870 A * 1/1985 Bell ..... F42B 12/38 102/511
5,121,691 A * 6/1992 Nicolas ..... F42B 12/204 102/205
5,275,083 A * 1/1994 Hawke ..... F42B 6/006 102/501
6,371,029 B1 * 4/2002 Beal ..... F42B 12/745 102/506
6,539,869 B2 * 4/2003 Knowlton ..... C06B 45/00 102/205
7,568,432 B1 * 8/2009 Baker ..... C06B 33/06 102/364
2003/0051629 A1 * 3/2003 Zavitsanos ..... C06B 33/00 102/510
2006/0288897 A1 * 12/2006 Williams ..... F42B 12/22 102/364
2008/0229963 A1 * 9/2008 Nielson ..... C06B 27/00 102/364
2009/0308272 A1 * 12/2009 Schroeder ..... F42B 12/06 102/364

* cited by examiner

*Primary Examiner* — Bret Hayes

(57) ABSTRACT

A biological active bullet able to be discharged from a firearm, the ammunition essentially comprising a bullet in a cartridge, the bullet including, and distinguished by the use of, at least one potentially reactive chemical substance delivered to a target and undergoing at least one violent exothermic chemical reaction with a bodily fluid of said target, and having at least one biological effect in the target upon impact and penetration, while causing tissue damage in addition to the bullet wound, and thus, having additional functions and applications than prior art bullets, along with methods of use, that ensure enhanced damage and lethality.

25 Claims, 3 Drawing Sheets

BIOLOGICAL ACTIVE BULLETS, SYSTEMS, AND METHODS

RELATED APPLICATION

The present application is a continuation-in-part of pending U.S. patent application Ser. No. 13/461,863 filed May 2, 2012, the subject matter of which is incorporated herein by reference.

BACKGROUND OF THE INVENTION

1. Field of the Invention

The present invention relates to a novel biological active bullet and more particularly pertains to a method for delivering at least one biological active substance to the body of a target upon bullet impact and penetration. The term "biological active substance" refers to any material that is biological, pharmaceutical, chemical, or radioactive that has at least some biological effect on or within the body of a target. This biological effect may include, but is not limited to, the interaction of this active substance with at least one of: organ systems, tissues, bodily fluids, cells, intracellular structures, and biochemicals. For instance, the desired biological effect of this biological bullet may include convulsions and disorientation that incapacitates a dangerous target. Or, the active substance delivered by this bullet may include stopping the heart or respiration of the target from an otherwise, non-fatal bullet wound. Biological active bullets can have the potential to make every shot fatal, and thus, have the ability to conserve ammunition. The result of biological effects serve additional functions not seen in other bullets, and therefore, the present invention also includes numerous other uses and improvements, with the ability to enhance modern warfare. Furthermore, the present invention allows the delivery of biological active substances to a target from a safe distance. This may prove useful in treating or neutralizing a disoriented or rabid individual carrying an infectious agent with epidemic potential. The present invention also affords the ability to deliver a wide range of active substances and combinations of active substances, and the ability to activate a substance upon impact and penetration.

2. Description of the Prior Art

Bullets are projectiles discharged and propelled from a firearm, such as a hand gun or rifle. Bullets have the primary function of piercing a living target, such as a human enemy, such as for military combat or self-defense.

Bullets have evolved many times over several centuries, resulting in many improvements, such as modern-day, metal jacketed bullet cartridges, invented by Swiss Major Eduard Rubin in the late 1800s, as described in U.S. Pat. No. 468,580.

However, it can be appreciated that there exists a need for a lethal bullet projectile including, and distinguished by the use of, at least one potentially reactive chemical substance, not involved in the propelling of the lethal bullet projectile to a target, whereby the at least one potentially reactive chemical substance undergoes at least one violent exothermic chemical reaction when coming in contact with and reacting with the bodily fluid of a target following impact and penetration, and thus, becoming biologically active. In this regard, the present invention substantially fulfills this need.

SUMMARY OF THE INVENTION

In view of the foregoing disadvantages inherent in the known types of bullet cartridges and projectiles of known designs and configurations now present in the prior art, the present invention provides an improved lethal bullet projectile; a lethal bullet projectile that becomes biologically active to ensure enhanced damage and lethality. As such, the general purpose of the present invention, which will be described subsequently in greater detail, is to provide a new and improved lethal bullet projectile; a biological active bullet system and method that causes increased damage to the tissues of a target, in addition to the bullet wound caused by the impact and penetration of this lethal bullet projectile. This biological active bullet system and method has all the advantages of prior art bullet projectiles and none of the disadvantages.

To attain this, the present invention essentially comprises a bullet in a cartridge. As with most cartridges, the cartridge of the present invention generally includes a bullet, a case/shell, a propellant, such as gunpowder or cordite, a primer which ignites the propellant once the firearm is triggered, along with an annular groove and flange of the casing, at the back-end of the bullet, that aids in loading the cartridge. The bullet optionally includes a jacket. Importantly, the bullet includes at least one potentially reactive chemical substance not involved in the propelling of the bullet, the bullet capable of being fired as a projectile from a firearm, and delivering said at least one potentially reactive chemical substance in the target upon impact and penetration. The at least one potentially reactive chemical substance reacting with a bodily fluid from the target to become biologically active and to cause damage and lethality in addition to the bullet wound, and thus, this lethal bullet projectile having additional functions and applications than prior art bullets.

The present invention also includes methods of associating the at least one potentially reactive chemical substance to the lethal bullet projectile, such as during manufacture, or out in the field. The present invention also includes methods of using the biological active bullet cartridge, including loading and discharging the cartridge to affect the target with the unique features of this novel invention to ensure the lethality of said lethal bullet projectile.

In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lethal bullet projectile which has all of the advantages of prior art bullets of known designs and configurations and none of the disadvantages.

It is another object of the present invention to provide a new and improved lethal bullet projectile and cartridge which may be easily and efficiently manufactured and marketed.

It is a further object of the present invention to provide a new and improved biological active bullet system which is of durable and reliable constructions.

An even further object of the present invention is to provide a new and improved biological active bullet system which is susceptible of a low cost of manufacture with regard to both materials and labor, and which accordingly is then susceptible of low prices of sale, thereby making such biological active bullet system economical. Because the lethal bullet projectile has the ability to rapidly kill a target that would otherwise survive a non-fatal gunshot wound, this invention also has potential to conserve ammunition.

Even still another object of the present invention is to provide a lethal bullet projectile for delivering at least one biological active substance to the body of a target upon bullet impact and penetration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying descriptive matter of preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
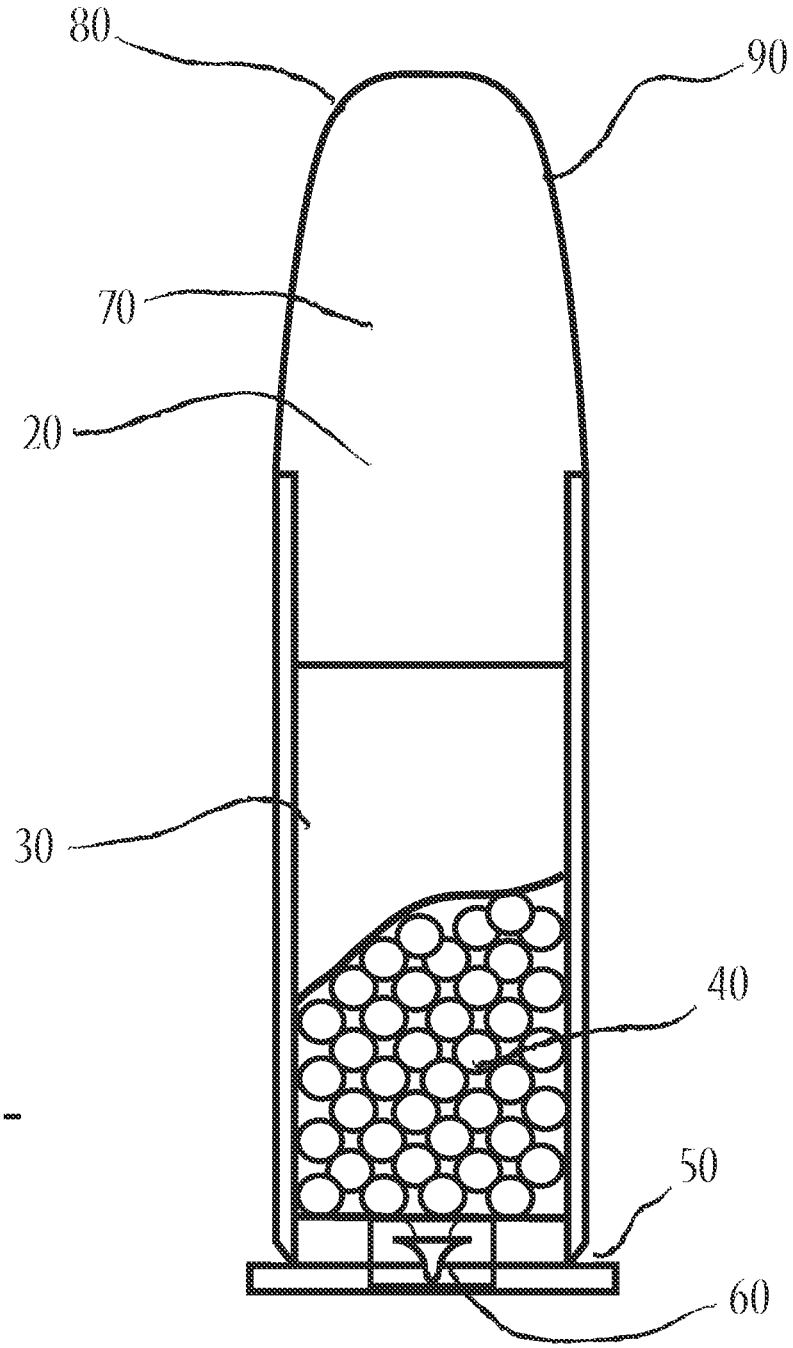
FIG. 1 shows a longitudinal cross-section of a new and improved biological active bullet cartridge, and revealing main components, including a lethal bullet projectile according to the first three preferred embodiments of the invention. The lethal bullet projectile includes, and is distinguished by the use of, at least one potentially reactive chemical substance not involved in the propelling of said lethal bullet projectile to a target; the at least one potentially reactive chemical substance comprising at least some of the material of the lethal bullet projectile body and or at least some of a potentially reactive layer under the jacket.

The preferred embodiment(s) of a new and improved lethal bullet projectile, a biological active bullet system and method embodying the principles and concepts of the present invention, will be described.

The present invention is a lethal bullet projectile structured to be packaged in a cartridge/shell and structured to be discharged from a firearm and used as a weapon. Ammunitions of the present invention are preferably structured to be used with existing handguns and rifles, such as those currently used by police and the military. Accordingly, biological active projectile bullet cartridges of the present invention, in their broadest context, include a bullet, which serves as the projectile; the case/shell, which holds the cartridge components; the propellant, which may preferably be gunpowder or cordite; the primer, which ignites the propellant once the firearm is triggered; along with an annular groove and flange of the casing, at the back-end of the bullet, that aids in loading the cartridge or extracting the empty cartridge (i.e., an extractor groove). The bullet optionally includes a jacket. The bullet optionally includes a surface that interacts with the rifling of the firearm barrel by having grooves and/or by being deformed by the riffling of the firearm barrel during discharge. Such components generally comprise a modern bullet cartridge and are not meant to be limiting.

Importantly, the lethal bullet projectile of the biological active projectile bullet cartridges of the present invention includes, and is distinguished by the use of, at least one potentially reactive chemical substance not involved in the propelling of said lethal bullet projectile to a target. The at least one potentially reactive chemical substance undergoes at least one violent exothermic chemical reaction when coming in contact with and reacting with a bodily fluid of a target, following impact and penetration of said lethal bullet projectile with said target. The target is preferably a living target, and more preferably a human combatant, although this weapon could also be used on an animal, such as a dangerous or rabid animal. The present invention may also provide for military contingency against conceivable future targets, which can include rabid or rabidly infected human targets, genetically modified or enhanced human targets, human hybrids, cybernetic humans, and even hostile humanoids of non-terrestrial origin. The at least one potentially reactive chemical substance preferably reacts with a bodily fluid of a target that is aqueous, and is preferably blood and/or lymph, although other bodily fluids, such as, but not limited to, intracellular fluid and cerebrospinal fluid, may also react.

The at least one violent exothermic chemical reaction preferably produces at least one result chosen from the group consisting of heat, caustic hydroxide(s), and hydrogen gas that causes increased damage to the tissues of the target, in addition to a wound caused by said impact and penetration of said lethal bullet projectile, to ensure enhanced damage and lethality of said lethal bullet projectile. The lethal bullet projectile of the invention includes, and is distinguished by the use of, at least one potentially reactive chemical substance, which is preferably a chemical element chosen from the class consisting of elemental lithium, elemental sodium, elemental potassium, elemental rubidium, elemental cesium, elemental magnesium, elemental calcium, elemental strontium, elemental barium, and elemental radium; i.e., certain Periodic Table Group 1 and Periodic Table Group 2 elements. The other elemental members of these groups, namely, hydrogen, francium, and beryllium, are not preferable for this invention. The element hydrogen has chemical properties which greatly differ from the other elements in its Periodic Table group. Although highly reactive, the element francium is not stable enough to be practical for this invention. In contrast, the element beryllium is not reactive enough to be practical for this invention. Elemental magnesium is the least reactive of the chemical elements chosen. However, elemental magnesium can be reactive enough when heated.

In a preferred embodiment, every two atoms of the Group 1 element chosen (e.g., rubidium) have the potential to react with two molecules of water from the aqueous bodily fluid (e.g., blood or lymph) of the target to produce two molecules of a Group 1 element hydroxide (e.g., rubidium hydroxide) and one molecule of diatomic hydrogen gas. Similarly, each atom of the Group 2 element chosen (e.g., barium) has the potential to react with two molecules of water from the aqueous bodily fluid (e.g., blood or lymph) of the target to produce one molecule of a Group 2 element hydroxide (e.g., barium hydroxide) and one molecule of diatomic hydrogen gas. The at least one potentially reactive chemical substance included with the lethal bullet projectile of the biological active projectile bullet cartridges of the present invention can also be a mixture or an alloy of certain Group 1 elements and or Group 2 elements. This alloy is thus preferably comprised of at least two chemical elements chosen from the class consisting of elemental lithium, elemental sodium, elemental potassium, elemental rubidium, elemental cesium, elemental magnesium, elemental calcium, elemental strontium, elemental barium, and elemental radium. For instance, the lethal bullet projectile can include a sodium-potassium alloy, or even a barium-calcium alloy, which reacts violently with aqueous bodily fluid to produce at least one violent exothermic chemical reaction. Such reactions of the biologically active projectile are highly exothermic and generate a significant amount of heat which will damage the surrounding tissues of the target; burning tissues, denaturing proteins and enzymes, and killing cells. The Group 1 or Group 2 element hydroxide produced may dissociate or further react.

An example of how the Group 1 or Group 2 element hydroxide produced may further react is as follows. If the lethal bullet projectile further includes aluminum, this aluminum will undergo a violent exothermic reaction with sodium hydroxide produced from the reaction of elemental sodium with water from aqueous bodily fluid. This reaction with aluminum would be more pronounced if the sodium hydroxide produced was locally concentrated in a more compartmentalized reaction environment, in or outside of the lethal bullet projectile. Therefore, the lethal bullet projectile can further include at least one additional potentially reactive chemical substance not involved in the propelling of said lethal bullet projectile to said target; said at least one additional potentially reactive chemical substance undergoing at least one chemical reaction with a product or intermediate of said violent exothermic chemical reaction when said at least one potentially reactive chemical substance comes in contact with and reacts with said bodily fluid of a target following impact and penetration of said lethal bullet projectile with said target.

It is important to mention that ions and/or compounds formed from the intermediates or products of said at least one violent exothermic chemical reaction can be poisonous, depending on which Group 1 or Group 2 element was chosen. For instance, if elemental barium was chosen, water soluble barium compounds and ions are poisonous. In small amounts, barium ion can serve as a muscle stimulant, but in larger amounts, barium ion can interfere with the nervous system, as it may block potassium ion channels. This could lead to impaired cardiac and respiratory function, weakness, or even paralysis, and may further increase the lethality of said lethal bullet projectile; thus having at least one biological effect in the target upon impact and penetration, in addition to the bullet wound, and thus, having additional functions and applications than prior art bullets.

The enzymes and proteins involved in the biological activities of cells and organs have an optimum pH range. Outside that pH range, the enzymes and proteins may be inactivated or denatured. The physiological pH of the blood is approximately 7.34 and that of intracellular cytosol is approximately 7.2. The caustic hydroxide(s) produced from the at least one violent exothermic chemical reaction have the potential to exceed the buffering capacity of the bodily fluid it comes in contact with and increase an at least localized pH of the bodily fluid to impair a biological activity of said target and cause further damage to said target. Caustic hydroxide(s) can kill cells and destroy tissues. When it is desirable to further enhance, reduce, or negate the effects of the caustic hydroxide(s), the lethal bullet projectile further includes at least one potentially pH altering substance not involved in the propelling of said lethal bullet projectile to said target, said at least one potentially pH altering substance chosen from the group consisting of acids and bases.

The at least one violent exothermic chemical reaction can produce copious amounts of gas, which is preferably hydrogen gas. Depending on the depth and location of the bullet wound in the target, gas will be produced much faster than it can escape. The gas produced will increase an at least localized internal pressure within the target to the extent that it has the potential to rupture or burst tissues of the target. In some instances, the internal pressure can be so great as for the gas to create its own exit wound on the target. In other instances, the hydrogen gas produced from said at least one violent exothermic chemical reaction causes the target to have a gas embolism from gas bubbles entering the vascular system. This can lead to a fatal stroke, heart attack, respiratory distress, and/or hypoxia; thereby enhancing the lethality of this biologically active bullet projectile.

Hydrogen gas is highly flammable and will burn even at low concentrations. Hydrogen gas reacts with every oxidizing agent, the most common of which is oxygen found in air surrounding the bullet wound, although oxygen is also found in blood gases primarily associated with hemoglobin. The heat generated from said at least one violent exothermic chemical reaction may ignite this hydrogen gas in the presence of oxygen. Hydrogen gas combines with oxygen to form water; a reaction which itself releases many kilojoules of energy. However, to ensure that the combustible hydrogen gas ignites, or to ensure that most of the hydrogen gas ignites before escaping the target, or to help sustain continuous combustion, the lethal bullet projectile can further include at least one igniter element not involved in the propelling of said lethal bullet projectile to said target. This igniter element is preferably a piezoelectric crystal, such as, but not limited to, quartz and is capable of piezo ignition when compressed by the projectile body and/or the target's body, such as during impact and penetration of said lethal bullet projectile with a target, thereby generating an electric arc. The piezoelectric crystal may additionally or alternatively become compressed by the at least one violent exothermic chemical reaction happening in proximity to it; with the fluid turbulence, pressure waves, and heat generated by the violent exothermic chemical reaction in the bodily fluid. Other igniter elements can be envisioned, including a micronized battery-resistor element, or a flint- or ferrocerium-element. These examples are not meant to be limiting. The combustion of the hydrogen gas generates an explosive force that further damages the target.

Hydrogen gas is a reducing agent, so the introduction of a different reducing agent can compete with the hydrogen gas for an oxidizing agent. When it is desirable to slow or decrease the oxidation of the hydrogen gas, the lethal bullet projectile further includes at least one reducing agent not involved in the propelling of said lethal bullet projectile to said target. However, it is generally more desirable to enhance the oxidation of the hydrogen gas. When it is desirable to further enhance the oxidation of the hydrogen gas, the lethal bullet projectile further includes at least one oxidizing agent not involved in the propelling of said lethal bullet projectile to said target. The lethal bullet projectile therefore can further include at least one substance with redox potential not involved in the propelling of said lethal bullet projectile to said target, said at least one substance with redox potential chosen from the group consisting of oxidizing agents and reducing agents. The oxidizing agent can be a halogen or halogen-containing molecule. As such, the lethal bullet projectile can further include at least one halogen or halogen-containing molecule not involved in the propelling of said lethal bullet projectile to said target. For example, hydrogen reacts very strongly with halogens such as fluorine, chlorine, or bromine to produce a hydrogen halide. An igniter element, such as one containing a small ultraviolet light generating LED and power source, may also help radicalize the halogen so it can react vigorously with the hydrogen gas. These hydrogen halides produced are very acidic and can damage tissue.

An oxidizing agent, such as a halogen, is also important as an at least one additional potentially reactive chemical substance, not involved in the propelling of said lethal bullet projectile to said target, because it also can react with the Group 1 element and/or Group 2 element chosen to form the corresponding Group 1 element halide or Group 2 element halide in a different violent exothermic chemical reaction.

Other oxidizing agents can be included with the lethal bullet projectile to react with the at least one potentially reactive chemical substance. Sulfur is another such oxidizing agent that reacts violently with Group 1 and Group 2 elements. The lethal bullet projectile can further include at least one catalytic substance not involved in the propelling of said lethal bullet projectile to said target, said at least one catalytic substance chosen from the class consisting of chemical catalysts and enzymes. For example, in the reaction of sulfur with a Group 1 element, such as sodium, a chemical catalyst such as the organic compound naphthalene can be used, to provide a reaction surface or speed the production of the Group 1 or Group 2 element sulfide, (e.g., sodium sulfide). Therefore, the lethal bullet projectile can further include at least one organic compound or organic molecule not involved in the propelling of said lethal bullet projectile to said target.

The lethal bullet projectile can further include at least one additional potentially reactive chemical substance not involved in the propelling of said lethal bullet projectile to said target; said at least one additional potentially reactive chemical substance undergoing at least one different violent exothermic chemical reaction when said at least one additional potentially reactive chemical substance comes in contact with and reacts with said bodily fluid of a target following impact and penetration of said lethal bullet projectile with said target. For instance, the lethal bullet projectile can further include at least one metal oxide not involved in the propelling of said lethal bullet projectile to said target. For instance, the lethal bullet projectile can also include calcium oxide, which reacts with water of the aqueous bodily fluid to produce calcium hydroxide and heat. The calcium oxide included with the lethal bullet projectile also represents at least one additional inorganic compound not involved in the propelling of said lethal bullet projectile to said target. Such reactions of the biologically active projectile are highly exothermic and generate a significant amount of heat which will damage the surrounding tissues of the target.

The lethal bullet projectile can include at least one Group 1 or Group 2 element hydride that reacts violently with an aqueous bodily fluid of said target. A Group 1 or Group 2 element hydride (e.g., calcium hydride) may also form from the Group 1 or Group 2 element (e.g., elemental calcium) reacting with the hydrogen gas and heat produced from said at least one potentially reactive chemical substance (e.g., elemental calcium) undergoing at least one violent exothermic chemical reaction when said at least one potentially reactive chemical substance comes in contact with and reacts with a bodily fluid of said target following impact and penetration of said lethal bullet projectile with said target.

The lethal bullet projectile can include other reactive compounds, including carbides and nitrides, and these examples are not meant to be limiting.

Other essential features of the biological active bullet system include the association of the new and improved lethal bullet projectile with the at least one potentially reactive chemical substance; along with preventing the at least one potentially reactive chemical substance from undergoing a chemical reaction before said impact and penetration of said lethal bullet projectile with said target. This can include preventing the at least one potentially reactive chemical substance from reacting during projectile manufacturing and projectile firing from a firearm.

The association of the lethal bullet projectile with the at least one potentially reactive chemical substance, not involved in the propelling of said lethal bullet projectile to a target, can be achieved by various means. The prevention of the at least one potentially reactive chemical substance from undergoing a chemical reaction before reaching the intended target can also be achieved by various means. The following embodiment examples provided herein are not meant to be limiting.

With reference now to the drawings, and in particular to FIG. 1 thereof, the first three preferred embodiments of the lethal bullet projectile of the new and improved biologically active bullet cartridge, embodying the principles and concepts of the present invention and generally designated by the reference numeral 10, will be described.

The biological active projectile bullet cartridge 10 of the present invention includes a plurality of components. Such components in their broadest context include a bullet 20, which serves as the lethal bullet projectile; the case/shell 30, which holds the cartridge components; the propellant 40, which may be gunpowder or cordite; an annular groove 50 (i.e., an extractor groove) or rim which is part of the casing that aids in loading the cartridge or extracting the empty cartridge; and the primer 60, which ignites the propellant. Such components generally comprise a modern bullet and are not meant to be limiting. The bullet 20 has a bullet projectile body 70 which is optionally and preferably at least partially jacketed or encased by a jacket 80; shown as a full jacket. As will be described in more detail, the bullet 20 is a lethal bullet projectile that can become biologically active because the at least one potentially reactive chemical substance comprises at least a portion of the bullet projectile body 70, either by being mixed in or integrated with other materials (e.g., lead, steel, bismuth, tungsten) of the bullet projectile body 70 during its formation (a first preferred embodiment of the invention); or the at least one potentially reactive chemical substance is the primary material which comprises most, if not all, of the lethal bullet projectile body (a second preferred embodiment of the invention). Additionally or alternatively, the bullet 20 is a lethal bullet projectile that can become biologically active because the at least one potentially reactive chemical substance comprises a potentially reactive layer 90, exterior to the bullet projectile body 70, and preferably interior to the jacket 80 (a third preferred embodiment). This potentially reactive layer 90 can be a sub-jacket or a coating that exists in the layer or boundary between bullet projectile body 70 and the jacket 80. As a sub-jacket, this potentially reactive layer 90 would preferably be jacketed over the bullet projectile body 70 before jacket 80 is put on to form the exterior most jacket. As a coating, this coating can be placed on the bullet projectile body 70 exterior surface and or the interior surface of the jacket 80. The at least one potentially reactive chemical substance, not involved in the propelling of said lethal bullet projectile to a target, comprising at least some of the bullet projectile body 70 material and or at least some of the potentially reactive layer 90, is a chemical element chosen from the class consisting of elemental lithium, elemental sodium, elemental potassium, elemental rubidium, elemental cesium, elemental magnesium, elemental calcium, elemental strontium, elemental barium, and elemental radium; or is an alloy comprised of at least two chemical elements chosen from the class consisting of elemental lithium, elemental sodium, elemental potassium, elemental rubidium, elemental cesium, elemental magnesium, elemental calcium, elemental strontium, elemental barium, and elemental radium.

In FIG. 1, the jacket 80 protects said at least one potentially reactive chemical substance from reacting with an environment external to said lethal bullet projectile before said impact and penetration of said lethal bullet projectile with said target. Inside said target, the jacket 80 breaks or fragments to expose the bullet projectile body 70 and or the potentially reactive layer 90 to a bodily fluid of said target. The bullet projectile body 70 and or at least some of the potentially reactive layer 90 can also include at least one inert, excipient substance that protects said at least one potentially reactive chemical substance from undergoing a chemical reaction before said impact and penetration of said lethal bullet projectile with said target.

In a first preferred embodiment of the invention, the at least one potentially reactive chemical substance is mixed in or integrated with the body of the bullet projectile during its formation. For example, if the bullet projectile body 70 is fully solid, the at least one potentially reactive chemical substance is preferably mixed in during casting of the bullet projectile body's main material (e.g., lead, steel, bismuth, tungsten). This said mixing in or integration is a physical process and not a chemical process. In other words, the at least one potentially reactive chemical substance is not meant to undergo a chemical reaction with the materials of the bullet projectile body during its construction. Therefore, if the at least one potentially reactive chemical substance is a Group 1 or Group 2 element, it will remain in its elemental form. The mixing in of the at least one potentially reactive chemical substance may be preferably performed under an inert atmosphere free of oxidizing agents (e.g., free of room air oxygen). This inert atmosphere can include that of a noble gas (e.g., helium). If any such inert atmosphere gets included inside the bullet projectile, the inert substance can be considered an excipient. The at least one potentially reactive chemical substance may first be placed in one or more protective pellets or coatings before being mixed in. If the bullet projectile body is not completely solid, i.e., is made up of powdered material or pellets itself, then the at least one potentially reactive chemical substance can be mixed in as a powder, pellet, or liquid during fabrication of the bullet projectile. Importantly, when the lethal bullet projectile is discharged from a firearm, at least some of the at least one potentially reactive chemical substance is exposed to a bodily fluid of a target upon impact and penetration of said lethal bullet projectile. This happens either as the lethal bullet projectile loses at least some of its jacket, and/or the lethal bullet projectile deforms/mushrooms, and/or the lethal bullet projectile breaks apart inside the target, thereby exposing at least some interior or interior contents of said bullet projectile.

Any deforming/mushrooming or frangibility property of said lethal bullet projectile can decrease target penetration and disrupt more tissue, and dissipate more energy, as it travels into the target, while reducing the risk of collateral damage. Such preferable properties can make it very likely that the lethal bullet projectile will remain in the target to deliver the at least one potentially reactive chemical effectively, instead of exiting the target and risking injury to an unintentional target.

In a second preferred embodiment of the invention, the at least one potentially reactive chemical substance comprises most, if not all, of the lethal bullet projectile body 70. For instance, the entire bullet or slug is comprised of the at least one potentially reactive chemical substance. Or, one or more lethal bullet projectile body sections are comprised of the at least one potentially reactive chemical substance. For example, if elemental cesium, elemental barium, or elemental radium is chosen for the projectile, these substances have densities of approximately 1.9, 3.5, and 5 grams per cubic centimeter, respectively near room temperature, and approach the density of steel, which is approximately 8 grams per cubic centimeter. Additional weight can be provided to the bullet projectile by choosing a denser material (e.g., tungsten with a density of approximately 19 grams per cubic centimeter) for the bullet jacket or other bullet projectile body sections (if more than one body section comprises the bullet projectile). Such preparations help ensure that the lethal bullet projectile is able to maintain adequate ballistics, such as, but not limited to, aerodynamic efficiency, synchronized spin, trajectory, and range.

In a third preferred embodiment of the invention, the at least one potentially reactive chemical substance comprises a potentially reactive layer 90 that at least partially surrounds the lethal bullet projectile body 70, as a sub jacket or coating, under the jacket 80.

In a fourth preferred embodiment of the invention, the at least one potentially reactive chemical substance is placed (e.g., filled, stuffed, or inserted) inside of at least one channel, pore, or cavitation of said lethal bullet projectile; either a channel, pore, or cavitation that was pre-existing from molding the lethal bullet projectile, and/or a channel, pore, or cavitation that was drilled into the lethal bullet projectile after casting. This channel, pore, or cavitation is then preferably sealed by the bullet's jacket or first sealed by some other material, such as an inactive ingredient or excipient, which may include, but is not limited to, mineral oil, petroleum jelly, wax, and or polymer.

Figure 2A:
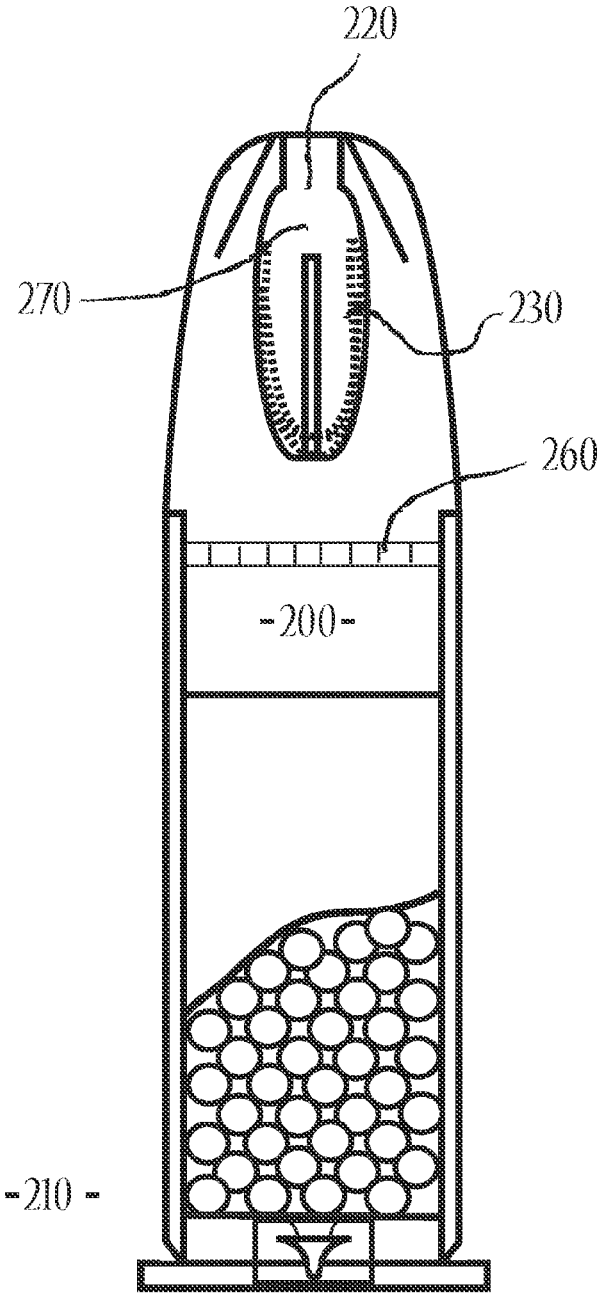
FIG. 2A shows the longitudinal cross-section of a biological active bullet cartridge containing a lethal bullet projectile according to a fourth preferred embodiment of the invention. This embodiment includes a lethal bullet projectile having at least one channel, pore, and or cavitation, and shown as a hollow point bullet with a hollow cavity containing a potentially reactive layer or coating comprised of or including at least one potentially reactive chemical substance not involved in the propelling of said lethal bullet projectile to a target.
Figure 2B:
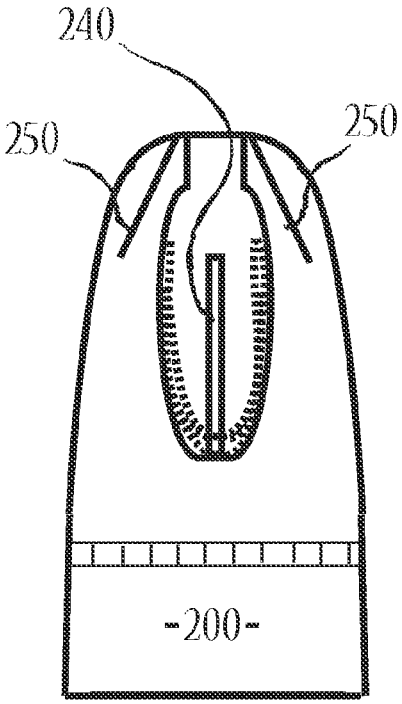
FIG. 2B shows the same longitudinal cross-section of this fourth preferred embodiment of the lethal bullet projectile after leaving the cartridge.

FIG. 2A shows the cross-section of a fourth preferred embodiment of a lethal bullet projectile 200, as a component of biological active projectile bullet cartridge 210; while FIG. 2B shows this same bullet after being discharged from its case. This embodiment resembles a common hollow point bullet. However, this is a biological active lethal bullet projectile as the hollow point cavity 220 contains a coating or potentially reactive layer 230 comprised of or including at least one potentially reactive chemical substance not involved in the propelling of said lethal bullet projectile to a target. This at least one potentially reactive chemical substance, not involved in the propelling of said lethal bullet projectile to a target, is a chemical element chosen from the class consisting of elemental lithium, elemental sodium, elemental potassium, elemental rubidium, elemental cesium, elemental magnesium, elemental calcium, elemental strontium, elemental barium, and elemental radium; or is an alloy comprised of at least two chemical elements chosen from the class consisting of elemental lithium, elemental sodium, elemental potassium, elemental rubidium, elemental cesium, elemental magnesium, elemental calcium, elemental strontium, elemental barium, and elemental radium. The at least one potentially reactive chemical substance can be adhered to or impressed into the surface lining the hollow point cavity 220 to form the potentially reactive layer 230. At least some of the potentially reactive layer 230 also includes or is covered by at least one inert, excipient substance that protects said at least one potentially reactive chemical substance from undergoing a chemical reaction before said impact and penetration of said lethal bullet projectile with said target. Also shown in this embodiment is a central pin 240 and bullet creases (radially inwardly directed ribs and alternating lines of weakness) 250, which aid in producing a mushrooming effect upon target penetration. A circumferential groove of generally corrugated appearance (circumferentially running cannelure) 260, which has been cut or impressed into a bullet or cartridge case, such as to help hold the bullet in its case, or such as is used when a roll crimp is applied to the bullet. Such a groove may also help remove empty cases of fired ammunition, and may be called an extractor groove. Additionally or alternatively, the hollow point cavity 220 can have an interior volume 270 that is occupied or filled by excipient substance, and or at least one potentially reactive chemical substance. For instance, the interior volume 270 of the hollow point cavity can be filled by at least one protective substance chosen from the group consisting of mineral oil, petroleum jelly, wax, and polymer that protects said at least one potentially reactive chemical substance from undergoing a chemical reaction before said impact and penetration of said lethal bullet projectile. In some forth preferred embodiments, the interior volume 270 contains or is a cap/plug which includes excipient substance, and or at least one potentially reactive chemical substance, as will be later described.

Figure 3A:
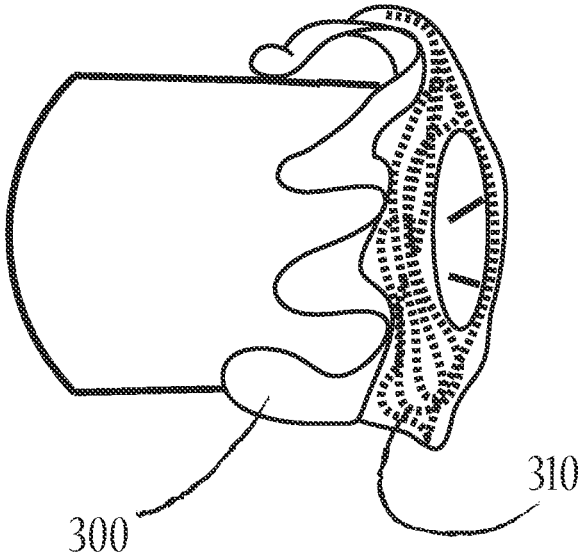
FIG. 3A shows the intended terminal ballistics of the fourth preferred embodiment hollow point, lethal bullet projectile, from a side view, after impact and penetration with a target. The lethal bullet projectile has expanded with a mushrooming effect. The hollow point has folded back, thereby, greatly exposing the potentially reactive layer or coating, so that the at least one potentially reactive chemical substance reacts with a bodily fluid of the target.
Figure 3B:
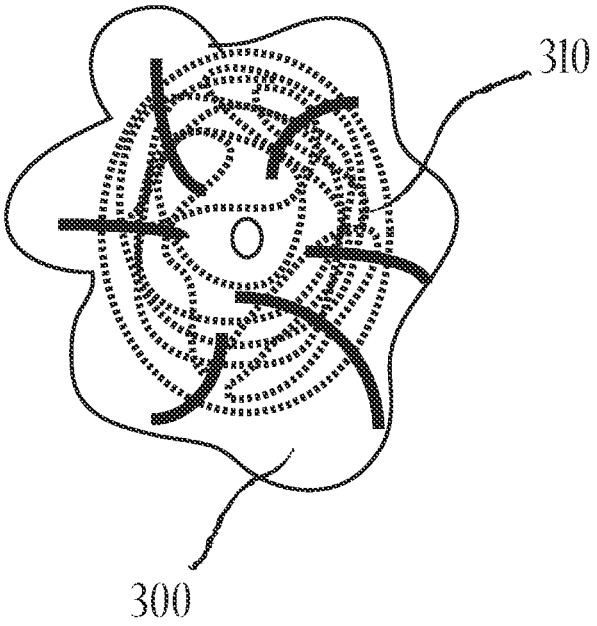
FIG. 3B shows this same alternative embodiment hollow point bullet, from a frontal view, after impact and penetration with a target. The hollow point has folded back, thereby, greatly exposing the biological active coating to the body of the target.

FIG. 3A shows the intended terminal ballistics (after impact and penetration) of what the forth preferred embodiment of the lethal bullet projectile 200 of FIG. 2 looks like from a side profile. FIG. 3B shows the mushrooming effect of the terminal ballistics from a frontal tip point of view, similar to that of a common jacketed hollow point bullet. Both FIG. 3A and FIG. 3B demonstrate how the hollow point folded back on itself, thereby, exposing the interior surface 300 of what once formed the hollow point cavity. The at least one potentially reactive chemical substance of the potentially reactive layer 310 in the hollow point cavity is now fully exposed to react with a bodily fluid of a target after impact and penetration.

In all of the above embodiments, it is essential that the at least one potentially reactive chemical substance is protected from reacting with an environment external to said lethal bullet projectile before said impact and penetration of said lethal bullet projectile with said target. Otherwise, the at least one potentially reactive chemical substance would almost certainly undergo chemical reaction with oxygen and moisture from atmosphere and/or the combustible gases from the bullet's discharge; which would likely cause harm to the shooter, other cartridges, and/or the firearm itself. As ammunition can get wet from rain or being submerged, an important feature of the invention is for the lethal bullet projectile to be weatherproof/waterproof to protect the at least one potentially reactive chemical substance, such as before the projectile reaches its target. Water repellent materials, coatings, and even laser etched surfaces and patterns can protect the lethal bullet projectile from moisture and liquids before reaching the said target.

Therefore, the lethal bullet projectile can further include at least one inert, excipient substance that protects said at least one potentially reactive chemical substance from undergoing a chemical reaction before said impact and penetration of said lethal bullet projectile with said target. As such, the lethal bullet projectile can further include at least one protective substance chosen from the group consisting of mineral oil, petroleum jelly, wax, and polymer that protects said at least one potentially reactive chemical substance from undergoing a chemical reaction before said impact and penetration of said lethal bullet projectile. Excipients may also help insulate the at least one potentially reactive chemical substance from the heat of firing the projectile.

Yet, excipients can also play an important role in associating the lethal bullet projectile with the at least one potentially reactive chemical substance. Therefore, the lethal bullet projectile can further include at least one excipient substance that at least partially associates said at least one potentially reactive chemical substance with said lethal bullet projectile at least before said impact and penetration of said lethal bullet projectile with said target. Such excipients may also aid in associating other active substances and/or other excipients. Excipients may adhere the at least one potentially reactive chemical substance to a inner surface of the bullet jacket, or a surface, channel, pore, or cavitation of the lethal bullet projectile; either directly, or indirectly via other excipients or structural materials. If the adherent excipient will touch the at least one potentially reactive chemical substance directly, then the adherent excipient, such as a natural or synthetic resin, is selected to be unreactive with the at least one potentially reactive chemical substance. In this case, tiny holes/pores are made in the at least one potentially reactive chemical substance and possibly the bullet projectile body surface as well. Then, mechanical bonds can form as the adhesive excipient seeps into these tiny holes/pores and solidifies while the adhesive excipient's cohesive forces maintain integrity. Alternatively, the adherent excipient may not touch the at least one potentially reactive chemical substance directly. Instead, the at least one potentially reactive chemical substance may be encapsulated by a protective coating, which itself may be an excipient or structural material. Then, the adhesive excipient may form chemical bonds (e.g., absorption or chemisorption) with the protective encapsulation without risk of reacting with the at least one potentially reactive chemical substance before reaching a target.

In a fourth preferred embodiment of the invention, a cap/plug optionally helps seal a channel, pore, or cavitation of the lethal bullet projectile containing the at least one potentially reactive chemical substance. Alternatively, such a cap/plug can seal a channel, pore, or cavitation of the lethal bullet projectile containing a vial, such as, but not limited to a glass or plastic vial, which contains the at least one potentially reactive chemical substance. Again, adhesives can also be employed in these embodiments. Alternatively still, the cap/plug can be comprised of material that is rigid, semi-rigid, non-rigid, resilient, frangible, or nonfrangible. This cap/plug may stay intact upon impact or may fragment. This cap/plug may be porous and have the at least one potentially reactive chemical substance embedded in it, or may dissolve when in contact with bodily fluids. In some fourth preferred embodiments, this cap/plug may be comprised of the at least one potentially reactive chemical substance itself or as a mixture of the at least one potentially reactive chemical substance and other excipients. In other words, this cap/plug may serve as a vial containing potentially reactive chemical substances, or serve as a scaffold for holding and delivering potentially reactive chemical substances, or function like a tablet.

For example, the potentially reactive chemical substance may help form a solid of a desired shape that is adapted to fit the shape of the cavity as a cap/plug, to help retain the substance in a fixed position, so as to help prevent interference with the bullet's trajectory. In other examples, the cap/plug can be secured by the jacket of the bullet, or the cap/plug may have securing means, such as threads designed adapted to fit complementary securing means, such as threads, in the bullet cavity.

In an alternative fourth preferred embodiment, hollow-point bullets have a large cavitation that can contain the at least one potentially reactive chemical substance, although this is a large, exteriorly facing cavity and would require a jacket over the hollow-point and/or these above alternative embodiment methods to protect the at least one potentially reactive chemical substance from reacting before reaching the bodily fluids of the target. If all or most of the hollow-point cavity is filled with the at least one potentially reactive chemical substance, although the hollow-point cavity is no longer empty, the at least one potentially reactive chemical substance is substantially softer so that this projectile embodiment essentially maintains its hollow-point functionality upon impact and penetration. A cap/plug containing or comprising the at least one potentially reactive chemical substance may be inserted into the hollow-point cavity before being sealed in or the hollow-point projectile being jacketed.

In another alternative fourth preferred embodiment, the at least one potentially reactive chemical substance is contained in at least one internal cavitation shared by two or more lethal bullet projectile body sections, which may at least partially separate inside said target.

Importantly, the lethal bullet projectile of the biological active bullet system according to the invention has an unexpected property that existing bullet projectiles do not have. Therefore, the lethal bullet projectile according to the invention represents a major advancement in bullet ammunitions technology. Unless the momentum of a fired bullet is high enough to create an exit wound, all other prior art bullet projectiles will come to rest inside a human target after the momentum from firing the bullet has dissipated; as its kinetic energy is transferred to the tissues of that target. Surprisingly, the lethal bullet projectile according to the invention does not stay at rest after the momentum from the firing of the bullet has dissipated, and instead, unexpectedly causes additional tissue penetration wounds, beyond that caused by the initial impact and penetration of the lethal bullet projectile body. This effect is attributed to the lethal bullet projectile's intimate association with the at least one potentially reactive chemical substance, as described in all the various embodiments; whether the at least one potentially reactive chemical substance comprises at least a portion of a bullet projectile body, or was integrated with at least a portion of a bullet projectile body, or was adhered to at least a portion of a bullet projectile body, and other associations still.

The at least one violent exothermic chemical reaction with a target's bodily fluid and the least one potentially reactive chemical substance, associated with and/or comprising at least a portion of a bullet projectile body, emits copious amounts of hydrogen gas to provide thrust to at least a portion of a bullet projectile body inside the target. This begins just about when the lethal bullet projectile body has come to rest. The at least one violent exothermic chemical reaction, caused by said at least one potentially reactive chemical substance coming in contact with and reacting with said bodily fluid of a target following impact and penetration of said lethal bullet projectile, further causes movement of fluid and at least one portion of said lethal bullet projectile inside said target, thereby causing increased tissue damage of said target beyond that of initial impact and penetration of said lethal bullet projectile. Said thrust of gases can occur in one or more directions, simultaneously, alternatingly, or sporadically. The movement caused by said gas thrust can be erratic and follow linear and/or circular paths. A portion of said lethal bullet projectile may also have angular momentum from said gas thrust and spin inside the target. The lethal bullet projectile has a considerable chance of being relocated a significant distance from the initial point of entry. Tissues and organs not initially damaged by the impact and penetration of said lethal bullet projectile can be damaged by this post-firing, gas thrust. Possible ignition and combustion of said hydrogen gas emitted can also affect the movement of the lethal bullet projectile inside the target. These unexpected results further enhance the lethality of said lethal bullet projectile and represent a vast improvement over existing prior art bullets.

The lethal bullet projectile of the present invention is capable of delivering a wide range of quantity of at least one potentially reactive chemical substance, such as less than, up to, and over, one gram.

The lethal bullet projectile of the invention is preferably structured to be discharged from a firearm; although in some alternative embodiments; the lethal bullet projectile of the invention may be structured to be propelled by air guns or rail guns.

In preferred embodiments, the lethal bullet projectile of the invention is structured to be propelled from a bullet propelling device, including, but not limited to, hand guns, revolvers, semi-automatic weapons, automatic weapons, rifles, and sniper rifles; although in some alternative embodiments, the lethal bullet projectile of the invention may be structured to be propelled from shotguns.

The lethal bullet projectile of the invention is preferably chosen from the class of bullets, including, but not limited to, nonfrangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, nonjacketed bullets, and jacketed bullets. In some embodiments, the lethal bullet projectile comprises no more than one or two bullet body portions; while in alternative embodiments, the lethal bullet projectile comprises more than two bullet body portions or a plurality of subprojectiles.

The biological active bullet ammunition system preferably includes a cartridge containing a lethal bullet projectile of the invention, and preferably includes a cartridge containing at least a propellant and a lethal bullet projectile of the invention, and still more preferably, includes a cartridge containing at least a propellant, a primer, a case/shell, and a lethal bullet projectile of the invention. The invention may also be a magazine containing at least one cartridge containing a lethal bullet projectile according to the invention. The invention may also be a firearm, such as but not limited to a gun, containing at least one cartridge of lethal bullet projectile according to the invention. Although less preferable, in other embodiments the firearm may also be unique in that it can be further specifically adapted to load and discharge at least one specifically adapted lethal bullet projectile according to the invention.

Importantly, the lethal bullet projectile is capable of making a normally non-fatal gunshot wound fatal. The lethal bullet projectile is also capable of maintaining adequate ballistics, such as, but not limited to, aerodynamic efficiency, synchronized spin, trajectory, and range.

The body of the lethal bullet projectile can be comprised of at least one material chosen from the group of hard materials, including, but not limited to, aluminum, antimony, beryllium, bismuth, boron carbide, brass, bronze, chromium, cobalt, copper, gold, iridium, iron, lead, mercury, molybdenum, nickel, palladium, platinum, rhodium, silicon carbide, silver, steel, hardened steel, tantalum, tellurium, tin, titanium, tungsten, tungsten carbide, carbon fiber, depleted uranium, zinc, zirconium, metalloids, alloys, and any combinations thereof. However, in some alternative embodiments, polymers and nano-materials may be used.

The lethal bullet projectile may further include at least one integrated circuit, chosen from the class of electronic circuit containing elements, including, but not limited to, microchips, nanobots, data transmitters, sensors, radio-frequency identification (RFID) tags, implants, bioelectronic devices, or any combination thereof, such as to deliver this circuit to the target and track/manipulate the biological target.

The lethal bullet projectile may further include at least one energy source, chosen from the class of power sources, including, but not limited to, fuels, fuel cells, batteries, electrolytes, biological powered batteries, and energy derived of kinetic energy from motion.

The lethal bullet projectile may further include at least one active/potentially active substance, chosen from the class of active substances, including, but not limited to, chemically active substances, biologically active substances, radioactive substances, thermodynamically active substances, and pharmaceutically active ingredient substances, and any combinations of active substances thereof and capable of delivering this at least one active substance to/within a target, including, but not limited to, a mammal, such as a human, and having at least one effect/biological effect on the target, in addition to the bullet wound.

The lethal bullet projectile is capable of including biological active substances in a variety of formats, such as solids, liquids, gels, pastes, films, fast-dissolving formats, slow-release formats, along with a variety of excipients that may aid the delivery of the substance(s).

The invention may also be a biological active bullet ammunition system that is able to deliver at least one substance of a wide range of different biologically active substances to a target to cause a biological effect.

The invention may also be a biological active bullet ammunition system that is able to deliver a combination of different biologically active substances to a target to cause a combination of biological effects.

The at least one biological active substance may exist in an active state or a potentially active state. Substances that exist in a potentially active state require activation. Activation may be achieved by various ways, such as from interaction with the target itself, including bodily tissues and fluids, bodily enzymes, and extracellular, cellular, or mitochondrial proteins and cofactors; and/or the conditions therein, such as the temperature and pH found in the body. For example, the potentially active substance may require processing by bodily protease enzymes for activation, or require mineral cofactors found in the target's blood. In other examples, activation may take place from the interaction of the substance with an excipient, other active, or other substance, also associated with the bullet. For instance, the potentially active substance may be a catalyst requiring a cofactor for significant activation. This cofactor may also be associated with the bullet, but unable to interact with the catalyst until the two substances are mixed together during impact and penetration of the bullet.

The invention may also be an interchangeable cap/plug and biologic active bullet system, so that a cap/plug associated with at least one biologic active substance can be interchanged with a cap/plug associated with a different biologic active substance, so as to vary/customize the desired biologic effects using the same cartridge platform.

The invention may also be a non-interchangeable cap/plug and biologic active bullet system, so that a cap/plug associated with at least one biologic active substance cannot be interchanged with a cap/plug associated with a different biologic active substance, said bullet and bullet cavity are adapted to fit only a specific cap/plug associated with a certain biologic active substance, so as to prevent confusion and tampering of the bullet system.

The invention also includes methods of constructing and manufacturing said lethal bullet projectile with said at least one potentially reactive chemical substance, along with methods of use of the lethal bullet projectile, including, but not limited to, methods of loading and firing said lethal bullet projectile, methods of delivering with this bullet at least one potentially reactive chemical substance to a target, along with methods of use of ensuring enhanced damage and lethality.

The invention may also be a method of applying an active substance within a cavity of a bullet, chosen from bullet cavities, such as, but not limited to, a hollow point cavity. The invention may also be a hollow point bullet projectile with at least one potentially reactive chemical substance occupying at least some portion of the hollow point cavity. The invention may also be a method of applying an at least one potentially reactive chemical substance to deep within a cavity of a bullet, chosen from bullet cavities, such as, but not limited to, a hollow point cavity, such as to ensure that the at least one potentially reactive chemical substance cannot be touched by the firearm user, such as by not coming into contact with the with hands or fingers, when handling the bullet cartridge.

The invention may also be a method of manufacturing at least one lethal bullet projectile according to the invention.

The invention may also be a method of adding at least one active substance to at least one lethal bullet projectile according to the invention.

The invention may also be a method of adding at least one potentially reactive chemical substance to at least one lethal bullet projectile according to the invention.

The invention may also be a method of adding at least one inactive substance to at least one lethal bullet projectile according to the invention.

The invention may also be a method of adding at least one excipient to at least one lethal bullet projectile according to the invention.

The invention may also be a method of adding at least one active substance to at least one lethal bullet projectile according to the invention using at least one excipient.

The invention may also be a method of adding at least one potentially reactive chemical substance to at least one lethal bullet projectile according to the invention using at least one excipient.

The invention may also be a method of switching active substances in at least one lethal bullet projectile according to the invention.

The invention may also be a method of switching potentially reactive chemical substances in at least one lethal bullet projectile according to the invention.

The method may also include the adding or switching of potentially reactive chemical substances and/or other active substances out in the field.

The invention may also be a method of stabilizing over time a lethal bullet projectile according to the invention.

The invention may also be a method of storing a lethal bullet projectile according to the invention.

The invention may also be a method of labeling and identifying a lethal bullet projectile according to the invention.

The invention may also be a method of loading into a firearm, such as but not limited to a gun, at least one magazine or projectile cartridge of lethal bullet projectile according to the invention.

The invention may also be a method of discharging/firing from a firearm, such as but not limited to a gun, at least one lethal bullet projectile according to the invention.

The invention may also be a method of tracking a lethal bullet projectile according to the invention after it has been discharged.

The invention may also be a method of activating or detonating a lethal bullet projectile according to the invention after it has been discharged and/or penetrated a target.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those described in the specification are intended to be encompassed by the present invention.

Therefore, the foregoing is considered as descriptive only of the principles of the invention. Further, since numerous modifications and changes will readily occur to those skilled in the art, it is not desired to limit the invention to the exact construction and operation described, and accordingly, all suitable modifications and equivalents may be resorted to, falling within the scope of the invention.

What is claimed as being new and desired to be protected by Letters Patent of the United States is as follows:

1. A lethal bullet projectile structured to be packaged in a cartridge/shell and structured to be discharged from a firearm and used as a weapon;

said lethal bullet projectile including, and distinguished by the use of, at least one potentially reactive chemical substance not involved in the propelling of said lethal bullet projectile to a target;

said at least one potentially reactive chemical substance undergoing at least one violent exothermic chemical reaction only when said at least one potentially reactive chemical substance comes in contact with and is triggered by and reacts directly with a bodily fluid of bodily temperature at around 37° C. of said target, and without requiring additional heat, following impact and penetration of said lethal bullet projectile with said target;

said at least one violent exothermic chemical reaction producing at least one result chosen from the group consisting of heat, caustic hydroxide(s), and hydrogen gas that causes increased damage to tissues of said target, in addition to a wound caused by said impact and penetration of said lethal bullet projectile, to ensure enhanced damage and lethality of said lethal bullet projectile.

2. The lethal bullet projectile as set forth in claim 1 wherein said at least one potentially reactive chemical substance is a Group 1 element chosen from the class consisting of elemental lithium, elemental sodium, elemental potassium, elemental rubidium, and elemental cesium.

3. The lethal bullet projectile as set forth in claim 1 wherein said at least one potentially reactive chemical substance is a Group 2 element chosen from the class consisting of elemental calcium, elemental strontium, elemental barium, and elemental radium.

4. The lethal bullet projectile as set forth in claim 1 wherein said at least one potentially reactive chemical substance is an alloy comprised of at least two chemical elements chosen from the class consisting of elemental lithium, elemental sodium, elemental potassium, elemental rubidium, elemental cesium, elemental calcium, elemental strontium, elemental barium, and elemental radium.

5. The lethal bullet projectile as set forth in claim 1 wherein said caustic hydroxide(s) produced from said at least one violent exothermic chemical reaction increase an at least localized pH of said bodily fluid of said target to impair a biological activity of said target and cause further damage to said target.

6. The lethal bullet projectile as set forth in claim 1 wherein said hydrogen gas produced from said at least one violent exothermic chemical reaction increases an at least localized internal pressure in said target to cause at least some said tissues of said target to burst.

7. The lethal bullet projectile as set forth in claim 1 wherein said hydrogen gas produced from said at least one violent exothermic chemical reaction causes the target to have a gas embolism from gas bubbles entering the vascular system.

8. The lethal bullet projectile as set forth in claim 1 wherein said at least one violent exothermic chemical reaction, caused by said at least one potentially reactive chemical substance coming in contact with and reacting with said bodily fluid of said target following impact and penetration of said lethal bullet projectile, further causing movement of fluid and at least one portion of said lethal bullet projectile inside said target, thereby causing increased tissue damage of said target beyond that of initial impact and penetration of said lethal bullet projectile.

9. The lethal bullet projectile as set forth in claim 1 and further including at least one igniter element not involved in the propelling of said lethal bullet projectile to said target; said at least one igniter element igniting combustible said hydrogen gas produced from said at least one violent exothermic chemical reaction when said at least one potentially reactive chemical substance comes in contact with and reacts with said bodily fluid of said target following impact and penetration of said lethal bullet projectile; said igniting of combustible said hydrogen gas causing further damage to said target.

10. The lethal bullet projectile as set forth in claim 1 wherein said at least one potentially reactive chemical substance is prevented from undergoing a chemical reaction before said impact and penetration of said lethal bullet projectile with said target.

11. The lethal bullet projectile as set forth in claim 1 wherein said at least one potentially reactive chemical substance is protected from reacting with an environment external to said lethal bullet projectile before said impact and penetration of said lethal bullet projectile with said target.

12. The lethal bullet projectile as set forth in claim 1 and further including at least one inert, excipient substance that protects said at least one potentially reactive chemical substance from undergoing a chemical reaction before said impact and penetration of said lethal bullet projectile with said target.

13. The lethal bullet projectile as set forth in claim 1 and further including at least one protective substance chosen from the group consisting of mineral oil, petroleum jelly, wax, and polymer that protects said at least one potentially reactive chemical substance from undergoing a chemical reaction before said impact and penetration of said lethal bullet projectile.

14. The lethal bullet projectile as set forth in claim 1 and further including at least one excipient substance that at least partially associates said at least one potentially reactive chemical substance with said lethal bullet projectile at least before said impact and penetration of said lethal bullet projectile with said target.

15. The lethal bullet projectile as set forth in claim 1 and further including at least one additional potentially reactive chemical substance not involved in the propelling of said lethal bullet projectile to said target; said at least one additional potentially reactive chemical substance undergoing at least one different violent exothermic chemical reaction when said at least one additional potentially reactive chemical substance comes in contact with and reacts with said bodily fluid of said target following impact and penetration of said lethal bullet projectile with said target.

16. The lethal bullet projectile as set forth in claim 1 and further including at least one additional potentially reactive chemical substance not involved in the propelling of said lethal bullet projectile to said target; said at least one additional potentially reactive chemical substance undergoing at least one chemical reaction with a product or intermediate of said violent exothermic chemical reaction when said at least one potentially reactive chemical substance comes in contact with and reacts with said bodily fluid of said target following impact and penetration of said lethal bullet projectile with said target.

17. The lethal bullet projectile as set forth in claim 1 and further including at least one catalytic substance not involved in the propelling of said lethal bullet projectile to said target, said at least one catalytic substance chosen from the class consisting of chemical catalysts and enzymes.

18. The lethal bullet projectile as set forth in claim 1 and further including at least one additional inorganic compound not involved in the propelling of said lethal bullet projectile to said target.

19. The lethal bullet projectile as set forth in claim 1 and further including at least one halogen or halogen-containing molecule not involved in the propelling of said lethal bullet projectile to said target.

20. The lethal bullet projectile as set forth in claim 1 and further including at least one potentially pH altering substance not involved in the propelling of said lethal bullet projectile to said target, said at least one potentially pH altering substance chosen from the group consisting of acids and bases.

21. The lethal bullet projectile as set forth in claim 1 and further including at least one metal oxide not involved in the propelling of said lethal bullet projectile to said target.

22. The lethal bullet projectile as set forth in claim 1 and further including at least one substance with redox potential not involved in the propelling of said lethal bullet projectile to said target, said at least one substance with redox potential chosen from the group consisting of oxidizing agents and reducing agents.

23. The lethal bullet projectile as set forth in claim 1 and further including at least one organic compound or organic molecule not involved in the propelling of said lethal bullet projectile to said target.

24. A lethal bullet projectile structured to be packaged in a cartridge/shell and structured to be discharged from a firearm and used as a weapon;

said lethal bullet projectile including, and distinguished by the use of, at least one potentially reactive chemical substance not involved in the propelling of said lethal bullet projectile to a target;

said at least one potentially reactive chemical substance is a chemical element chosen from the class consisting of elemental lithium, elemental sodium, elemental potassium, elemental rubidium, elemental cesium, elemental calcium, elemental strontium, elemental barium, and elemental radium;

said at least one potentially reactive chemical substance undergoing at least one violent exothermic chemical reaction only when said at least one potentially reactive chemical substance comes in contact with and is triggered by and reacts directly with a bodily fluid of bodily temperature at around 37° C. of said target, and without requiring additional heat, following impact and penetration of said lethal bullet projectile with said target;

said at least one violent exothermic chemical reaction producing at least one result chosen from the group consisting of heat, caustic hydroxide(s), and hydrogen gas that causes increased damage to tissues of said target, in addition to a wound caused by said impact and penetration of said lethal bullet projectile, to ensure enhanced damage and lethality of said lethal bullet projectile.

25. A lethal bullet projectile structured to be packaged in a cartridge/shell and structured to be discharged from a firearm and used as a weapon;

said lethal bullet projectile including, and distinguished by the use of, at least one potentially reactive chemical substance not involved in the propelling of said lethal bullet projectile to a target;

said at least one potentially reactive chemical substance is an alloy comprised of at least two chemical elements chosen from the class consisting of elemental lithium, elemental sodium, elemental potassium, elemental rubidium, elemental cesium, elemental calcium, elemental strontium, elemental barium, and elemental radium;

said at least one potentially reactive chemical substance undergoing at least one violent exothermic chemical reaction when said at least one potentially reactive chemical substance comes in contact with and reacts with a bodily fluid of said target following impact and penetration of said lethal bullet projectile with said target;

said at least one violent exothermic chemical reaction producing at least one result chosen from the group consisting of heat, caustic hydroxide(s), and hydrogen gas that causes increased damage to tissues of said target, in addition to a wound caused by said impact and penetration of said lethal bullet projectile, to ensure enhanced damage and lethality of said lethal bullet projectile.

* * * * *